United States Patent [19]

Block et al.

[11] Patent Number: 4,476,760

[45] Date of Patent: Oct. 16, 1984

[54] CUTTING SYSTEM

[75] Inventors: Charles Block, North Bellmore; Leon Mintz, Syosset, both of N.Y.

[73] Assignee: Joseph Galkin Corporation, Hicksville, N.Y.

[21] Appl. No.: 468,001

[22] Filed: Feb. 18, 1983

[51] Int. Cl.[3] ..... B26D 5/08

[52] U.S. Cl. ..... 83/582; 83/639; 83/644; 83/694

[58] Field of Search ..... 83/583, 589, 639, 644, 83/694, 609, 583, 568, 584, 589

[56] References Cited

U.S. PATENT DOCUMENTS

| | | | |
|---|---|---|---|
| 3,151,515 | 10/1964 | Suverkrop | 83/583 |
| 3,791,248 | 2/1974 | Pearson | 83/694 |
| 3,793,919 | 2/1974 | Lefebvre | 83/583 |
| 3,886,828 | 6/1975 | Müller | 83/644 |
| 3,911,775 | 10/1975 | Peason | 83/636 |
| 3,933,070 | 1/1976 | Walters et al. | 83/639 |
| 4,079,649 | 3/1978 | Ishii et al. | 83/582 |

*Primary Examiner*—Frank T. Yost
*Assistant Examiner*—Hien H. Phan
*Attorney, Agent, or Firm*—Paul J. Sutton

[57] ABSTRACT

A fluid actuated cutting machine comprising a stationary lower blade and a vertically movable upper blade mounted at one end to a pivot rod. The upper blade is disposed at angle relative to the horizontal plane. The other free end of the upper blade is disposed beyond a vertical plane on which lies the cutting edge of the lower blade. A pressure arm, mounted on a cantilivered beam connected to the base of the machine, acts against any tendency for the upper blade to align its cutting edge with the cutting edge of the lower blade. During its downward movement, the upper blade is constantly drawn from its horizontally angled position relative to the lower blade towards alignment with the lower blade. This movement is resisted by the pressure arm. The resistance causes a firm cutting pressure between the two blades at the constantly moving contact point during the downward movement of the upper blade.

8 Claims, 6 Drawing Figures

CUTTING SYSTEM

BACKGROUND OF THE INVENTION

The present invention relates generally to the art of cutting machines and more particularly to machines for cutting cloth and fabric.

The art of cloth cutting provides machines of varying complexity for accomplishing the task of a fine cut for cloth clothing, decoration, and similar purposes. Many of these machines are complex and expensive to build. One of the perennial problems in the art is to obtain a firm shearing or cutting relationship between the cutting blades. Another related problem has been to accomplish the task of obtaining a quality cutting relationship between the cutting blades in an inexpensive, reliable manner, that is, with a sturdy, reliable cloth cutting machine that is efficient to operate, and will produce a high quality of cut of cloth and fabric.

SUMMARY OF THE INVENTION

The present invention contemplates the elimination of the limitations and disadvantages of conventional solutions to recognized needs of the art.

Accordingly, it is an object of my invention to provide a relatively inexpensive and reliable apparatus for cutting fabric.

Another object of the invention is to provide a novel means for obtaining a high quality of shearing relationship between the two blades.

Yet another object of this invention is to provide a novel relationship between the upper cutting edge and the lower cutting edge by crossing the upper edge over to lower edge prior to the cutting operation.

Yet a further object of my invention is to provide a cutting apparatus that lowers a vertically angled cutting blade into cutting relationship with a cloth being fed into the cutting line while the free end of the upper blade is being pressed across the cutting edge of the lower stationary blade to create a highly efficient cutting contact.

Another object of my invention is to provide an apparatus that lowers and raises a vertically angled upper blade into and from cutting contact respectfully with a lower stationary blade while simultaneously providing a pressure against the free end of the upper blade that causes the upper blade to be pressed toward a crossed-over horizontal angle with the lower blade or to resist movement from the crossed-over position.

Another object of my invention is to provide an apparatus that biasedly exerts via a pressure arm a cross-pressure on the free end of an upper blade so that it tends to or resists being moved from a horizontal angle relative to a lower blade, the angle being preferably approximately 5 degrees.

Yet another object of my invention is to provide a novel and inexpensive apparatus that is very easy to manufacture operate, and maintain that accomplishes a highly efficient and effective task in cutting cloth and fabric.

The present invention fulfills the above objects and overcomes the limitations of prior art by providing a stationary lower blade supported upon a base platform and having a first horizontal cutting edge and an upper blade having a second cutting edge associated with the lower blade disposed at an angle relative to the lower blade. The upper blade is connected to a drive block that is mounted on a pivot rod. The drive block is vertically removable on the rod and also rotatably movable around the rod. The drive block is driven by a pressurized air system between up and down positions. The upper blade is carried by the drive block between upper and lower positions. The second cutting edge of the upper blade in its upper position is in cutting contact with the first cutting edge of the lower blade proximate to the connected end of the upper blade, while the remainder of the upper blade extends over and past the lower blade to a position where the free end of the upper blade is disposed above and beyond the first cutting edge. A pressure arm is hung from a cantilevered beam which is in turn mounted to the base platform. The pressure arm is equipped with a pressure roller extending from the lower portion of the arm and that is in bearing contact with the free end portion of the upper blade, acting against any tendency for the upper blade to align its second cutting edge with the first cutting edge of the lower blade. When the drive block is driven downwards, the cutting contact between the two blades point moves steadily along each blade from the connected end portion of the upper blade and proximite to the connected end of the upper blade towards the free end portion of the upper blade and to the distant end of the lower blade until the final cutting point at the end of the upper blade is reached. During this movement, the upper blade is cohstantly drawn from its horizontally angled position relative to the lower blade towards alignment with the lower blade. This movement is resisted by the pressure roller and the biasable pressure arm. This resistance causes a firm cutting pressure between the two blades at the constantly moving cutting contact point during the downward movement of the upper blade. The pressure arm is rotatably hung from the cantilevered beam in a plane perpendicular to the first cutting edge. This rotational arc of movement can be restricted by arc adjustion, mechanism associated with the pressure arm. When the upper arm is pressured upwards by the drive block, the drive block rotates with the upper arm back to its first position with the upper blade angled over to lower blade. During this upward movement, the upper arm pressures the upper blade across the lower blade at an increasing distance as the cutting contact point retreats to the connected end portion. At its first position, the upper blade again assumes the horizontal angle it assumed before. Preferably, this angle is approximately 5 degrees. When cloth is positioned into the cutting line between the blades, it is cut with a sharp, firm, and constant cutting pressure at the moving cutting point.

BRIEF DESCRIPTION OF THE DRAWING

This invention will be more clearly understood from the following description of specific embodiments of the invention, together with the accompanying drawings, wherein similar reference characters denote similar elements throughout the several views, and in which.

DESCRIPTION OF THE PREFERRED EMBODIMENT

Rererring now in more detail to the drawings it is noted that a number of terms and expressions used throughout this specification to designate terms and expressions have been chosen merely as a matter of convenience for the reader.

Figure 1:
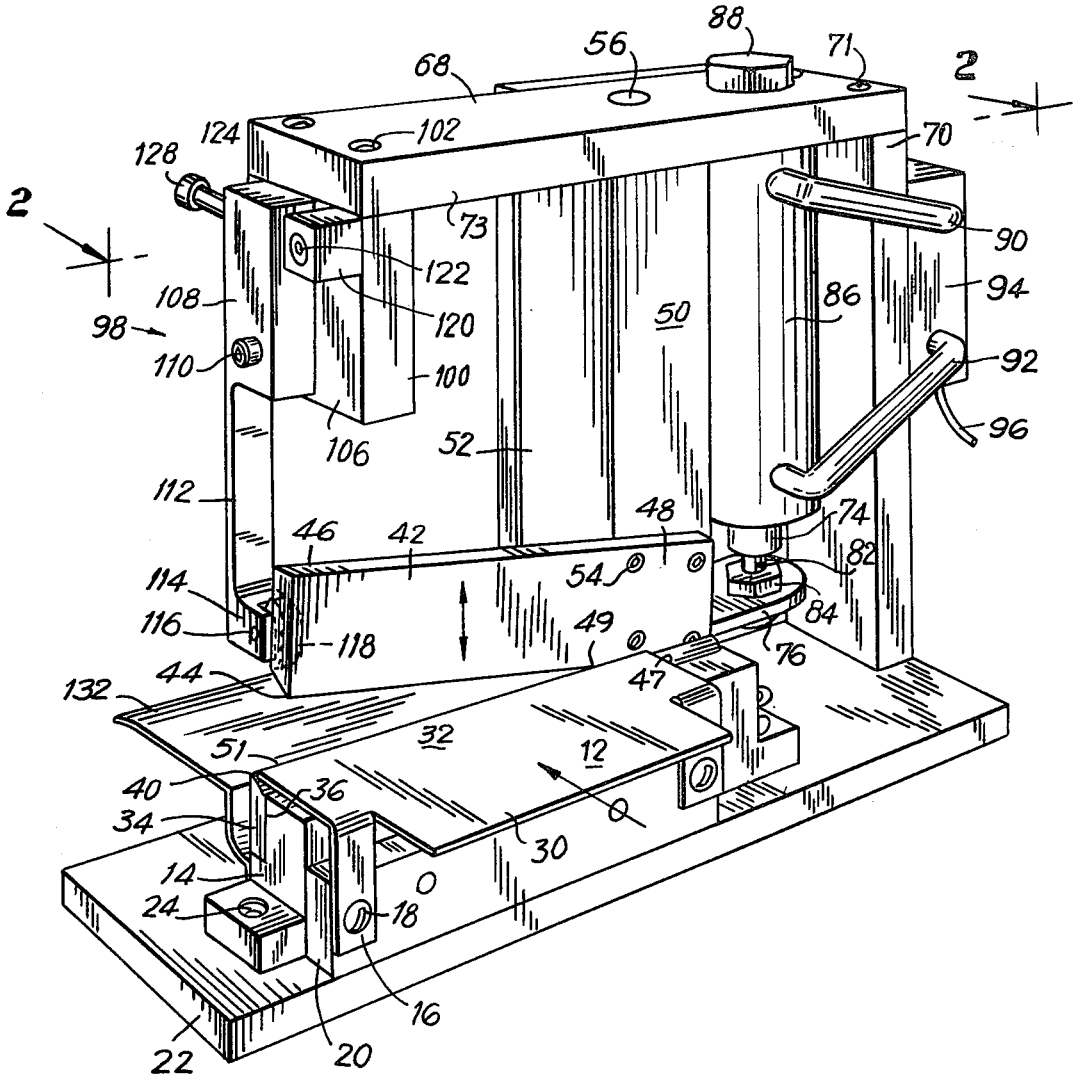
FIG. 1 is a perspective view of the apparatus with the upper blade in the upper position.

FIG. 1 illustrates in a perspective view the overall apparatus according to this invention. A table, or anvil, 12 is supported by inner support block 14 and is connected to block 14 by down flanges 16 by screws 18 that extend through outer support block 20 into block 14. Blocks 14 and 20 are in turn supported by base platform 22. Block 14 is secured to platform 22 by screws 24. Anvil 12 has a flat, horizontal upper surface which is for supporting cloth or fabric 26 to be cut (FIG. 3) being drawn by a fabric puller (not shown) from feed rollers 28 positioned outside of apparatus 10 in the area of cloth feeding shelf, 30, which extends outward from anvil 12 beyond platform 22. Cloth 26 is fed from the rollers across shelf 30 across anvil surface 32 to fixed, or stationary, lower knife blade 34, which is positioned in a longitudinal recess 36 that runs the full length of inner support block 14 beyond anvil 12. Recess 36 is approximately over the center portion of platform 22. Stationary lower blade 34 is secured to inner block 14 by screws 38, one of which is shown in the cross-section of FIG. 3. Lower blade 34 has a straight first cutting edge 40 running horizontally and disposed along the length of inner block 14 and occupying the corner length of anvil 12 and on substantially the same vertical level as anvil surface 32. Directly above lower blade 34 is mating upper blade 42 having a second straight cutting edge 44. Upper blade 42 and in particular second cutting edge 44 are positioned at an angle relative to horizontal first cutting edge 40.

Figure 5:
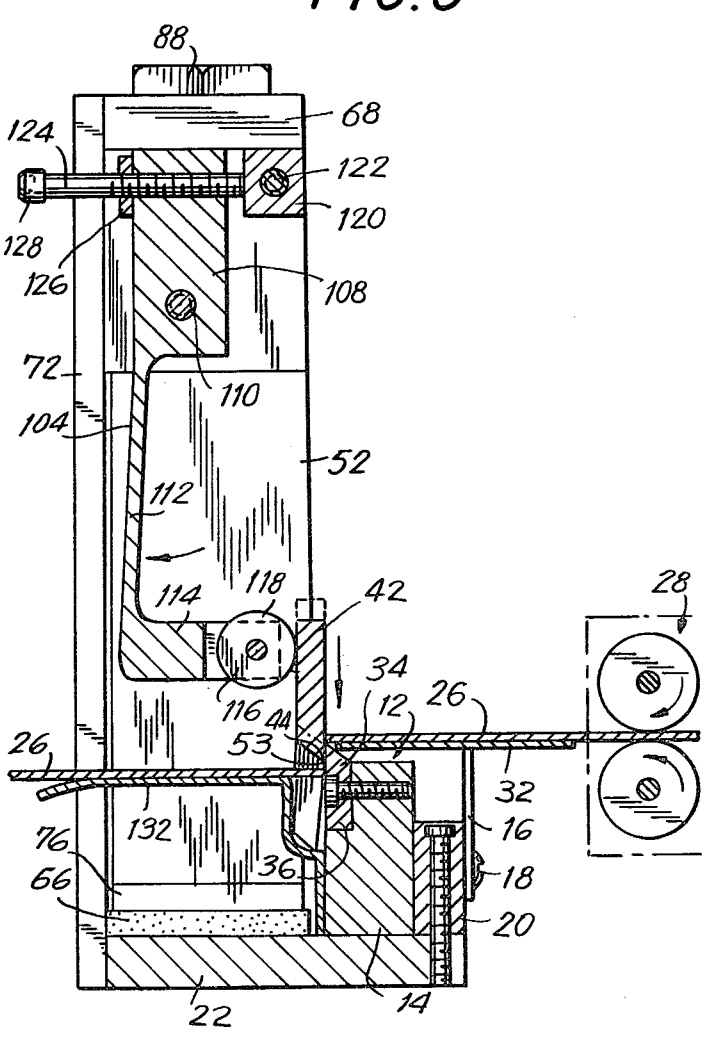
FIG. 5 is a view taken through line 4—4 in FIG. 4 similar to the view in FIG. 3 except that the upper blade is in a lowered position.
Figure 6:
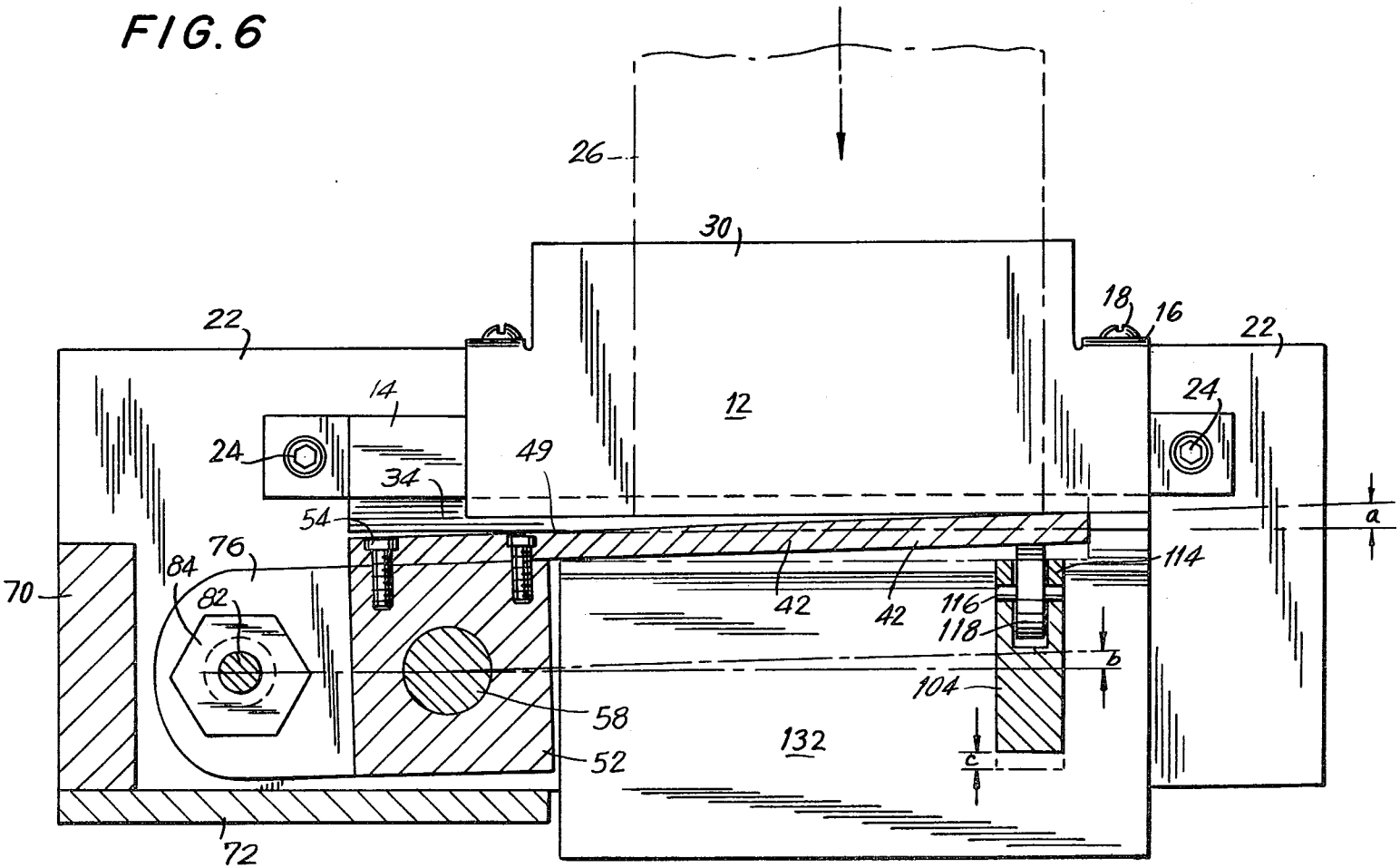
FIG. 6 is a top view of the apparatus taken through line 6—6 in FIG. 4.

As shown in FIGS. 2, 3, 4, and 5, upper blade 42 has free end 46 and opposed connected end 48, which is secured to flat face 50 of vertical drive block 52 by four screws 54. Drive block 52, which is preferably approximately rectangular in horizontal cross-section as illustrated in FIG. 6, can be moved up and down on vertical pivot and guide rod 56 between upper and lower positions, as illustrated in FIGS. 2,3,4,5, and 6. Drive block 52 is also rotatably movable about pivot and guide rod 56 between a first outward position and a second inward position, along with connected upper blade 42, as will be explained in detail below. The vertical plane containing blade 42 is tangential to pivot rod 56, and blade 42 along with second cutting edge 44 is tangentially rotatable about pivot rod 56.

As shown in FIGS. 1,2,3, and 6 lower blade 34 and upper blade 42 intersect at connected end 48 of the upper blade and the portion of the lower blade proximate to connected end 48 of the upper blade, that is, proximate end 47 of the lower blade at first cutting contact point 49 when upper blade 42 is in its first upper position. As will be discussed in detail below and as shown in FIGS. 4 and 5, upper blade 42 and lower blade 34 intersect at free end 46 of the upper blade and the portion of the lower blade distant from proximate end 47 of the lower blade, that is, opposed distant end 51 of the lower blade at a second cutting contact point 53 when upper blade 42 is in its lower position. In the upper position as seen in FIG. 6, upper blade 42 is slightly askew from lower blade 34 at connected end 48 in the upper position. In the lower position of the upper blade, as shown in phantom lines in FIG. 6, the upper and lower blades are juxtaposed. Guide, or pivot rod 56 is mounted at its bottom end 58 into base bore 60 of base platform 22 and is secured to the platform by base screw 62 and to the beam by beam screw 63. Upper and lower shock absorbers, 64 and 66, which are preferably of rubber, are positioned at the upper and lower extents of the range of drive block 52 at overhead mounting beam 68 and platform 22, respectively. Overhead mounting beam 68 is connected to the top of end column 70 by screws 71; column 70 in turn is positioned upon the end of platform 22 and secured to the platform by welding or equivalent means. Beam 68 is also connected by welding or equivalent means to the top of rear mounting wall 72, which in turn is positioned along the surface of the rear wall of platform 22 from end column 70 approximately to the far end of drive block 52. Rear wall 72 is connected to platform 22 preferably by welding or equivalent means. Overhead beam 68 extends out beyond end column 70 and rear wall 72 over platform 22 for a distance to cantalevered end 73 of the beam to the free end 46 of upper knife blade 42.

Figure 2:
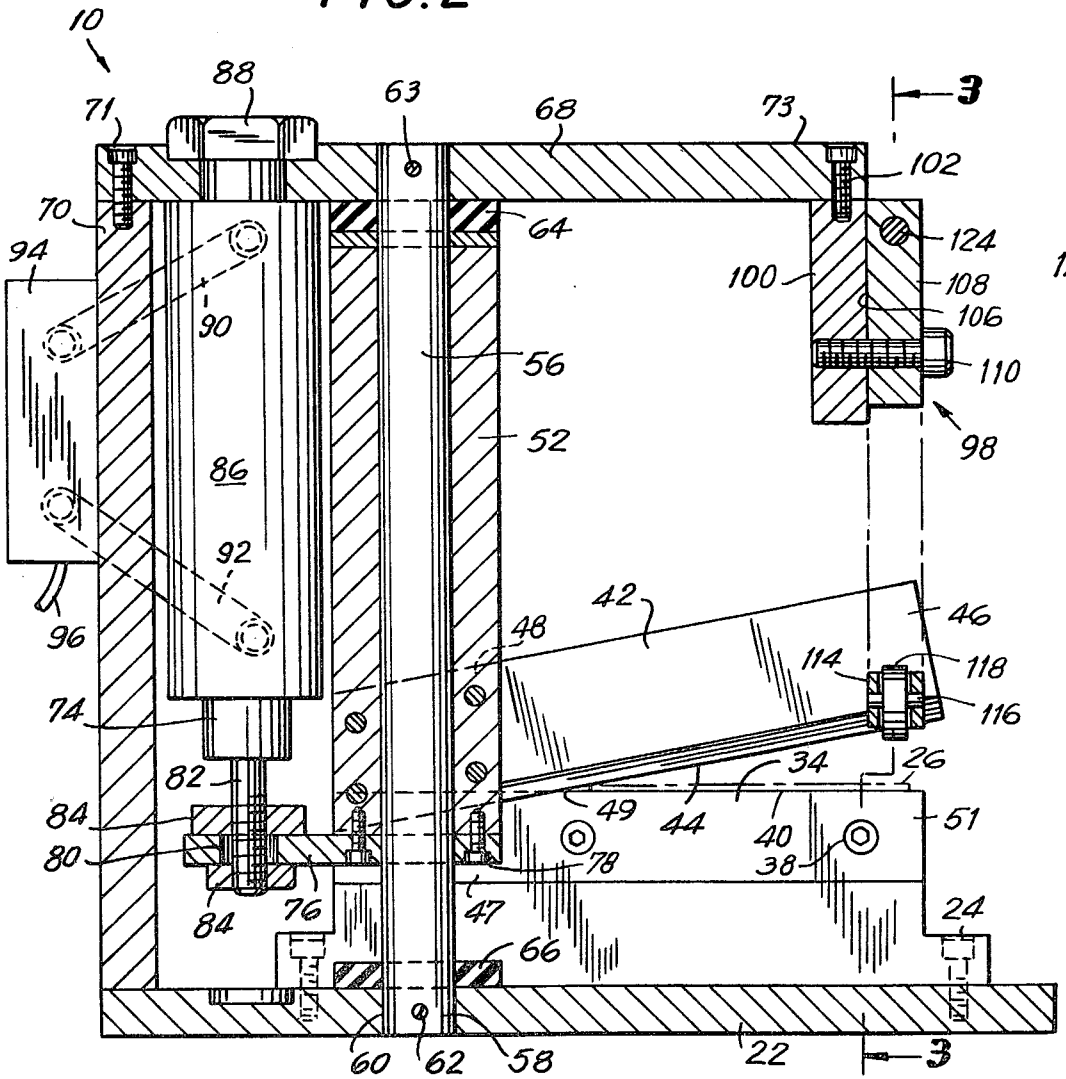
FIG. 2 is a rear cross-sectional view looking along the line 2—2 in FIG. 1.

Drive block 52 is driven up and down on guide rod 56 between its upper and lower positions along with upper blade 42 by pressurized air cylinder vertical piston 74, which is connected to the bottom of drive block 52 by bracket 76. Bracket 76 is preferably secured to the bottom of block 52 by screws 78 (FIGS. 2 and 4). Bracket 76 also forms horizontal bolt hole 80, which is adapted to receive piston bolt 82, which is a downward contination of vertical piston 74. Bolt nuts 84 are placed on both sides of bracket 76 on the threads of piston bolt 82 holding the bracket in a horizontally aligned position relative to piston 74. Bolt hole 80 is slightly larger than piston bolt 82 so that the bracket 76 us movable both vertically and horizontally relative to the piston bolt. Rotation of drive block 52 is thus not hindered by horizontal interference between the bracket and the piston bolt. In addition, vertical movement of drive block 52 is also not hindered by friction between the piston bolt and the bracket.

A pressurized air cylinder 86 is secured to top mounting beam 68 preferably by nut and bolt connection 88. Upper pressurized air line 90 for driving piston 74 downwards and lower pressurized air line 92 for driving piston 74 upwards connect the pressurized air cylinder with an external pressured air source (not shown). Pressurized air control box 94 is secured to the outer surface of end column 70. Electrical bond 96 connects the controls in the control box to a power source.

Lateral pressure assembly 98, the purpose of which is to exercise lateral movement against upper blade 42 as will be explained in detail below, extends downward from cantilevered end 73 of beam 68. Pressure assembly 98 includes mounting piece 100, which extends downwards from the undersurface of beam 68 and is connected to the beam by screws 102; and biasable pressure arm 104, which is rotatably secured to outer surface 106 of piece 100 at arm head 108 via threaded pivot bolt 110, which extends through head 108 and is screwed into piece 100. Sufficient play is left between piece 100 and head 108 to allow for the rotation of arm 104 about the bolt. Arm 104, besides head 108, also includes spring bar 112, which extends downwards from the inner side of head 108; and axle member 114, which is connected to the bottom of bar 112 and thrusts forward from it towards upper blade 42 with a forked end holding axle 116, which in turn mounts pressure roller 118. Roller 118 is in pressure contact with free end 46 of upper blade 42 during operation of apparatus 10. Pressure assembly 98 also includes pressure block 120, which is connected to the upper portion of mounting piece 100 by screw 122; and adjusting pin 124, which is disposed at the horizontal and threaded through arm head 108 from the far side of the head to pressure block 120. Pin 124 comes into adjustable bearing contact with pressure block 120, with the pressure being adjustable according to how much pin 124 is screwed relative to the pressure block. Lock nut 126 is positioned on the pin adjoining head 108 and serves to keep pin 124 locked into position in its set position. Pin head 128 gives finger grip to a user. Arm 104 is rotatable about pivot bolt 110 in response to pressure received at pressure roller 118 from upper blade 42, which will be discussed in detail below.

Figure 3:
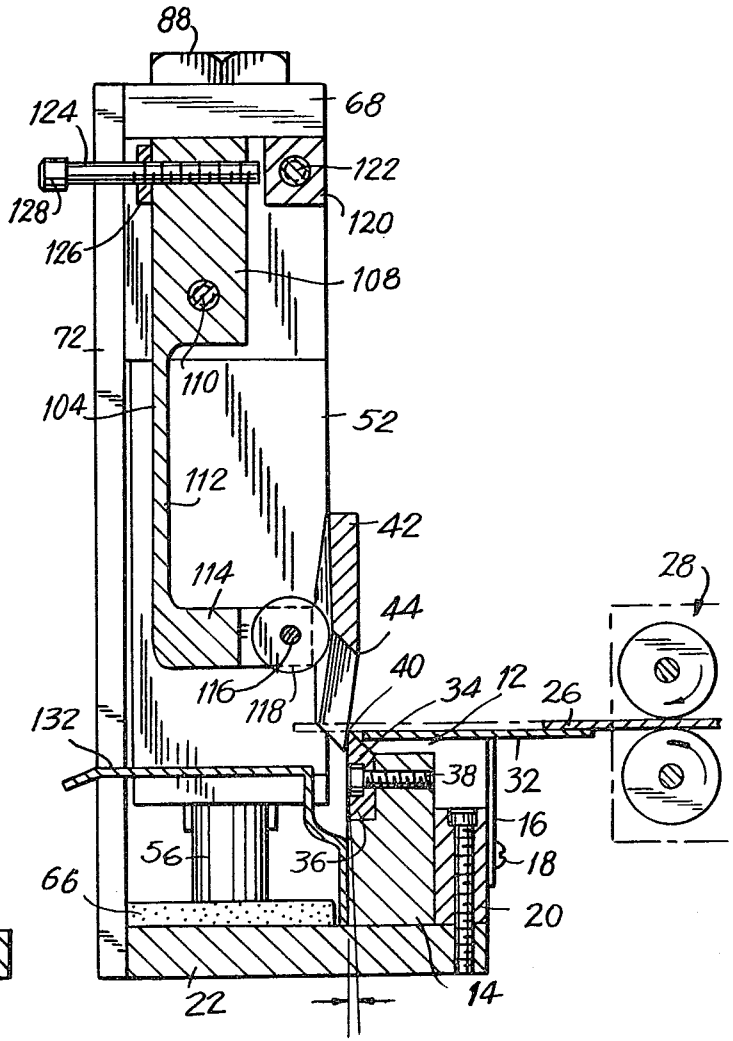
FIG. 3 is a side cross-sectional view taken along line 3—3 in FIG. 2.
Figure 4:
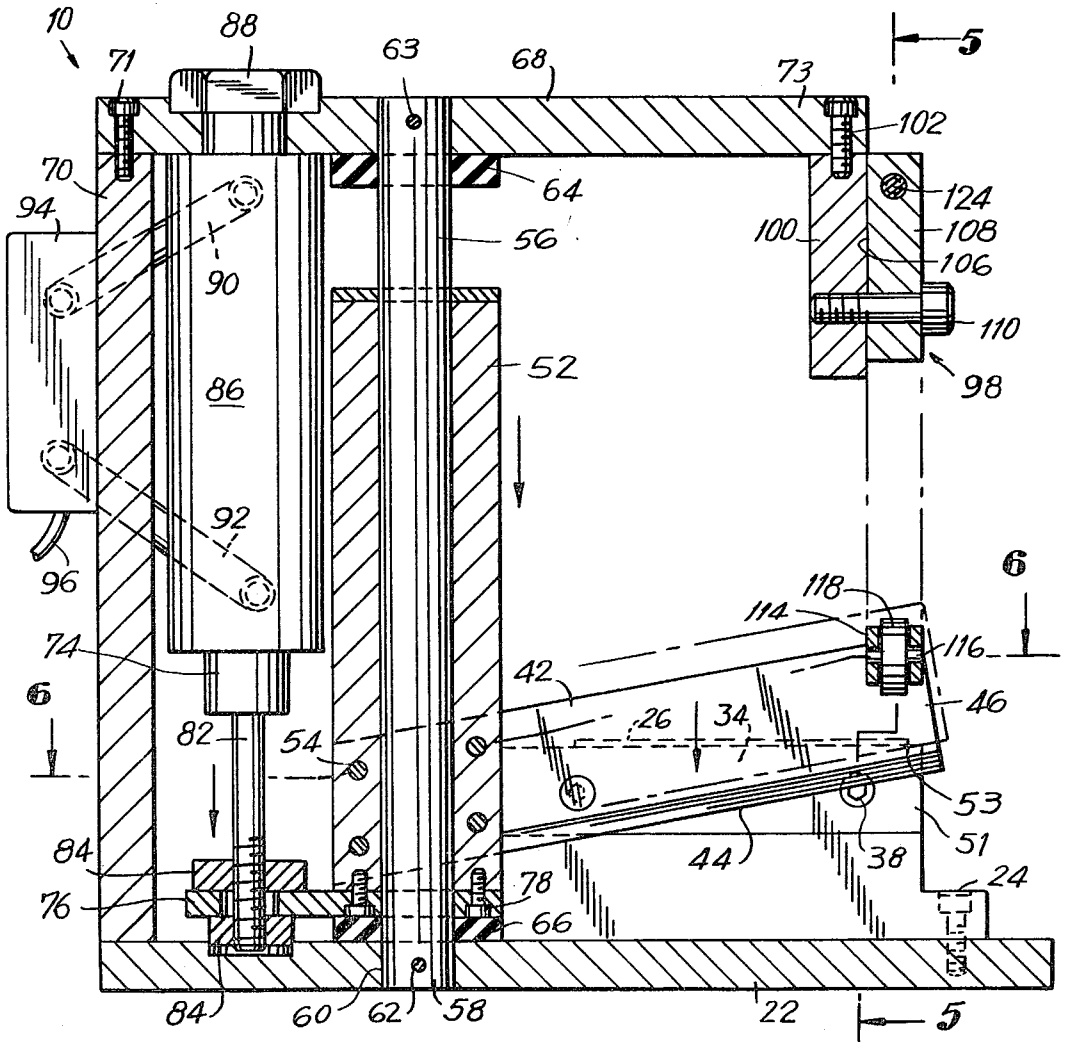
FIG. 4 is a view similar to the view in FIG. 2 except that the upper blade has been moved to a lowered position.

Upper blade 42 is vertically movable between an upper position, as illustrated in FIGS. 2,3, and 6; and a lower position as illustrated in FIGS. 4 and 5. Upper blade 42 is also tangentially rotatable about pivot and guide rod 56 as drive block 52 is rotated about rod 56, since upper blade 42, and particularly second cutting edge 44, is on a vertical plane substantially vertical to pivot rod 56. Upper blade 42 is rotatable in the manner described between first and second positions.

In the upper position and the first rotational position of blade 42, second cutting edge 44 is in cutting contact at connected end 48 at first cutting contact point 130; and second cutting edge 44 is spaced above said first cutting edge 40 as seen in FIGS. 2 and 3, and is simultaneously disposed past first cutting edge 40, as seen in FIG. 6. Upper blade 42, and in particular second cutting edge 44, in the first rotatable position, is positioned on the pivot rod 56 side of lower blade 44 and first cutting edge 40. In this first rotatable position, second cutting edge 44 passes over first cutting edge 40 at a point slightly past first cutting contact point 49 and continues on so that free end 46 is disposed a short distance past first cutting edge 40. Vertical plane containing first and second cutting edges 40 and 44 respectively moved from an acute angle, designated as angle a in FIG. 6. This acute angle is preferably approximately 5 degrees.

When pressure is applied to the pressurized air cylinder piston 74 via air cylinder 86 in the downward direction, drive block 52 is drawn downwards on pivot rod 56 by the piston and bracket 76 in turn driving upper blade 42 downwards, and moving second cutting edge 44 downwards from the upper to the lower upper blade position. Upper blade 42 is disposed inwards of lower blade 34 between blade 34 and pivot rod 56 with contact being made between the upper and lower blades at first cutting contact point 49. The remainder of blade 42 is crossed over lower blade 34 as described. Once drive block 52 pressures the second blade downwards, contact point 49 will move along the first and second cutting edges towards free end 46 of the upper blade, thus pulling the crossed-over portion of second cutting edge 44 into cutting contact with first cutting edge 40 and pulling upper blade 42 into flush alignment with lower blade 34 on the pivot side of the lower blade. Drive block 52 is positioned slightly askew, that is, at an angle to lower blade 34. As the drive block is pressured downwards, upper blade 42 is pulled back by the fact of the pressure cutting point between the two blades being shifted and drawing the upper blade inwards in a tangential rotation angle about pivot rod 56. As upper blade 42 pivots inwardly it levers drive block 52 rotationally around pivot rod 56.

During the tangential plane rotation of upper blade 42, the levering pressure drawing the upper blade inwards is opposed by pressure assembly 98 as pressure roller 118 is in bearing contact with the upper blade at the free end portion of the blade, specifically at a shifting pressure point that moves downward on the upper blade as the upper blade is forced down. This counterpressure from the pressure assembly via roller 118 keeps the constantly shifting cutting contact point at a high degree of cutting pressure as the upper blade is pressed against the lower blade. This novel means of exerting a steady pressure creates a cutting contact point of great effectiveness. Spring bar 112 is resilient and biasable and aids in keeping a steady, constant pressure against the upper blade as it is levered back from its crossed-over position relative to the lower blade. In addition, adjusting pin may be tightened or loosened so as to give some rotational play to pressure arm 104 about pivot bolt 110, with the plane of rotation being substantially perpendicular to first cutting edge 40.

As shown on FIGS. 4 and 5, upper blade 42 achieves its lower position and simultaneously its second rotational position. In the lower and first rotational positions, second cutting edge 44 is disposed substantially directly below first cutting edge 40 at the connected end 48 area and second and first cutting edges 44 and 40 are in cutting contact at second cutting contact point 53 at the free end 46 area of upper blade 42. The cutting contact point started at first cutting contact point 49 and moved along the two cutting blades during the movemant of the upper blade downwards and rotationally inwards, terminating at the final second cutting point 53. In fact, as shown in FIGS. 2 and 3, upper blade 42 will be driven downwards past its lower position as described until drive block 52 strikes lower shock absorber 56.

When pressured air is supplied so as to drive up block 52, and causing upper blade 52 to be forced upwards, movement of the blade from its lower and second positions to its upper and first positions is accomplished. Pressure from pressure assembly 98 via pressure roller 118 forces upper blade 42 across lower blade 42 until angle a is achieved and drive block 52 strikes upper shock absorber 64. As illustrated in FIG. 6, drive block 52 is rotated through an angle b about pivot rod 56; angle b and angle a are the same. Pressure assembly 98 moves a lateral distance relative to lower blade 38 between the first and second rotational positions of upper blade 42, this distance being designated distance b in FIG. 6.

Thus, when cloth or fabric 26 is fed from feed rollers 28 over anvil 12 and is stretched over lower blade 38 and outgoing cloth platform 130 connected to inner support block 14. As upper blade 42 moves from its first to its second position, the cloth is cut along the cutting contact points. When the cloth is cut, it drops into cloth wall 132 disposed below and adjacent to anvil 12. From there, the cloth is drawn away from apparatus 10.

The embodiments of the invention particularly disclosed here are presented merely as examples of the invention. Other embodiments, forms, and modifications of the invention coming within the proper scope of the appended claims will, of course, readily suggest themselves to those skilled in the art.

What is claimed is:

1. A cloth cutting apparatus, in combination, comprising:

a stationary lower blade supported upon a base platform and having a first horizontal cutting edge, an upper blade associated with said lower blade having a free end and a connected end and having a second cutting edge disposed at an angle relative to said lower blade, drive means including pivot means mounted upon said base platform, said drive means being for mounting said connected end of said upper blade and being vertically movable on and rotationally movable about said pivot means, said upper blade being vertically movable between upper and lower positions and simultaneously tangentially rotatable about said pivot means between first and second rotational positions respectively, wherein in said upper and first rotational positions, said first and second cutting edges are in cutting contact at a point at said connected end and said second cutting edge is spaced above and disposed past a vertical plane extending from said first cutting edge at said free end, and means for moving said drive means along with said upper blade between said upper and lower positions, and means for pressuring said free end portion of said upper blade against the tangential rotation of said upper blade during movement of said upper blade between said upper and first positions and said lower and second positions, whereby the second cutting edge is pressured against the first cutting edge at the cutting point during the descent of the second cutting edge from the upper to lower position.

2. A cloth cutting apparatus according to claim 1, wherein said lower blade has a proximate portion and an opposed distant portion, wherein in said first position said first and second cutting edges are in cutting contact at a first point at said connected end and proximate portion, and in said second position said first and second cutting edges are in cutting contact at a second point at said free end and distant portion.

3. A cloth cutting apparatus according to claim 2, wherein during the movement of said upper blade from said first to second positions the cutting contact points between said upper and lower blades move successfully along said blades from said first to said second cutting contact points.

4. A cloth cutting apparatus according to claim 3, wherein said drive means includes a pivot rod connected to said base platform, a drive block mounted about said pivot, said drive block being vertically movable upon said pivot rod and rotatably movable about said pivot rod, said drive block having at least one vertical face, said connected end of said upper blade being connected to said face.

5. A cloth cutting apparatus according to claim 4, wherein said means for moving said drive means includes a pressurized air cylinder connected to said base platform, a piston extending vertically downwards from said cylinder, means for connecting said piston to said drive block, means for supplying pressurized air to said cylinder for driving said piston upwards and downwards, and means for controlling the supply of pressurized air to said cylinder.

6. A cloth cutting apparatus according to claim 5, wherein said means for pressuring includes a pivot connected to said base platform, a biasable arm rotatably connected to and extending vertically from said pivot, said arm being rotational about said pivot on a second plane substantially perpendicular to said first cutting edge, a pressure roller extending horizontally from the bottom of said arm in bearing contact with the surface of the free end portion of said upper blade as said upper blade moves between said upper and first rotational positions and said lower and second rotational positions.

7. A cloth cutting apparatus according to claim 6, said means for pressuring further including a horizontal adjusting pin disposed through the upper portion of said arm substantially perpendicular to the vertical plane of said first cutting edge, a pressure block connected to said mounting means between said pin and said vertical plane, said pin being capable of being in varied bearing contact with said block, and locking means for keeping said pin in a set bearing alignment with said pressure block.

8. A cloth cutting apparatus according to claim 1, wherein in said upper and first rotational positions, said upper blade and said lower blade are contained in said second and said first vertical planes respectively, said vertical planes forming an acute angle, said acute angle being approximately 5 degrees.

* * * * *